US009975035B1

(12) United States Patent
Wang

(10) Patent No.: US 9,975,035 B1
(45) Date of Patent: May 22, 2018

(54) BIFURCATED SPRING-TETHERED ELECTRIC SKATEBOARD

(71) Applicant: Sheng Wang, Chino, CA (US)

(72) Inventor: Sheng Wang, Chino, CA (US)

( * ) Notice: Subject to any disclaimer, the term of this patent is extended or adjusted under 35 U.S.C. 154(b) by 0 days. days.

(21) Appl. No.: 15/607,372

(22) Filed: May 26, 2017

(51) Int. Cl.
*A63C 17/12* (2006.01)
*A63C 17/01* (2006.01)

(52) U.S. Cl.
CPC ..... *A63C 17/12* (2013.01); *A63C 17/016* (2013.01); *A63C 17/012* (2013.01); *A63C 2203/12* (2013.01)

(58) Field of Classification Search
CPC ..... A63C 2203/12; A63C 2203/40; A63C 2203/42
See application file for complete search history.

(56) References Cited

U.S. PATENT DOCUMENTS 4,082,306 A * 4/1978 Sheldon ..... A63C 17/01 280/11.28
2002/0149166 A1* 10/2002 Potter ..... A63C 17/004 280/87.042
2004/0262872 A1* 12/2004 Kang ..... A63C 17/0033 280/87.042
2006/0055137 A1* 3/2006 Jiang ..... A63C 17/01 280/87.042
2006/0163830 A1* 7/2006 Kwak ..... A63C 17/0033 280/87.042
2007/0273118 A1* 11/2007 Conrad ..... A63C 17/0033 280/87.042
2009/0295111 A1* 12/2009 O'Rourke ..... A63C 17/0033 280/86.751
2017/0151489 A1* 6/2017 Kim ..... A63C 17/011

* cited by examiner

*Primary Examiner* — Bryan A Evans
(74) *Attorney, Agent, or Firm* — Tommy S F Wang; Wang IP Law Group, P.C.

(57) ABSTRACT

A bifurcated spring-tethered electric skateboard is bifurcated into a front deck and rear deck with each deck having independently powered wheels. The skateboard has a mounted power source, generating electrical power for a motor that is transmitted to the wheels. A controller is configured to control the speed of the motor, and the wheels. The controller is electrically connected to the motor for direct control, or a wireless transmitter for remote control. A spring assembly connects the decks, creating a spring-tensioned effect between the decks while riding the skateboard. The uneven ride requires that the trucks do not rotate fully. A cable that connects the electrical components can also be damaged from excessive rotation of the trucks. Thus, the skateboard also provides a restriction tab at the bottom surface of the decks that engages the trucks to limit rotations thereof.

20 Claims, 4 Drawing Sheets

BIFURCATED SPRING-TETHERED ELECTRIC SKATEBOARD

FIELD OF THE INVENTION

The present invention relates generally to a bifurcated spring-tethered electric skateboard. More so, the present invention relates to a skateboard that is bifurcated into a front deck, a front truck, and a front pair of wheels, and a matching rear deck, rear truck, and rear pair of wheels; whereby an electric motor, a controller, and a power source operatively connect to the trucks to power each pair of wheels; whereby both front and rear wheels are powered by the electric motor to roll, and free to rotate independently of each other; whereby the controller transmits a signal to an electronic circuit carried on the skateboard to start or to stop the motor so that, the skateboard may be moved or stopped by electric power in addition to human force; whereby the trucks are restricted from fully rotating about the decks through a restriction tab; and whereby the front and rear decks are tethered by a spring assembly that produces a spring-tensioned and partially rotational relationship between the decks.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Generally, a skateboard is a type of sports equipment or toy used primarily for the activity of skateboarding, It usually consists of a specially designed Maplewood board combined with a polyurethane coating used for making smoother slides and stronger durability.

Typically, skateboards are equipped with steering mechanisms known as trucks. The trucks are mounted on the underside of a skateboard opposite to each other, one in the front and one, in the rear. Each truck carries two wheels, one at. each end of the truck's axle. Most skateboards are sold as separate elements, namely the deck, trucks, and wheels. These elements are assembled. together with a few accessories, by either the buyer or the retail seller.

Practically all trucks for skateboards, whether for serious competitive sport or pleasure use, comprise a mounting plate, known as a base plate, for bolting to the underside of the deck, a socket which may contain a bearing bush or liner and is formed in a block known as a yoke molded integrally with the base plate and depending therefrom as an angled projection, and a little spindle arm known as a hanger which is provided with a fixed axle for rotatably mounting one of the wheels at each end, The wheels of the skateboard are suspended in pairs from the underside of the deck by means of the trucks.

Typically in operation, the skateboard is moved by pushing with one foot while the other remains on the board, or by pumping one's legs in structures such as a bowl or half pipe. A skateboard can also be used by simply standing on the deck while on a downward slope and allowing gravity to propel the board and rider.

Other proposals have involved skateboards. The problem with these skateboards is that they do not magnify the force applied around the hose, and they are not self-powered.

Also, the deck does not create a wave-like riding sensation. Even though the above cited skateboards meets some of the needs of the market, a bifurcated spring-tethered electric skateboard. The skateboard is bifurcated into a front deck and rear deck with each deck having independently powered trucks and wheels; whereby the skateboard has a mounted power source, generating electrical power for a motor that is transmitted to the wheels; whereby the skateboard also provides a controller that controls the speed of the motor, and thereby the wheels, is still desired.

SUMMARY

Illustrative embodiments of the disclosure are generally directed to a bifurcated spring-tethered electric skateboard. The skateboard is bifurcated into a front deck and rear deck with each deck having independently powered trucks and wheels. The skateboard has a mounted power source, generating electrical power for a motor that is transmitted to the wheels. The skateboard also provides a controller that controls the speed of the motor, and thereby the wheels. The controller may be electrically connected to the motor for direct control or may include a wireless transmitter for remote control. A spring assembly connects the decks, creating a spring-tensioned effect between the decks while riding the skateboard. The spring effect creates a unique riding effect for a skateboarder. The uneven ride requires that the trucks do not rotate fully. A cable that connects the electrical components can also be damaged from excessive rotation of the trucks. Thus, the skateboard also provides a restriction tab at the bottom surface of the decks that engages the trucks to limit rotations thereof In some embodiments, the skateboard is bifurcated into a front deck, a front truck, and a front pair of wheels; and a matching, rear deck, rear truck, and rear pair of wheels. Further, the skateboard includes an electric motor, a controller, and a power source that operatively connect though a cable to the trucks, so as to power each pair of wheels. Both both front and rear wheels are electrically powered to roll, and free to rotate independently of each other. The controller transmits a signal to an electronic circuit carried on the skateboard to start or to stop the motor so that the skateboard may be moved or stopped by electric power in addition to human force.

In some embodiments, the front and rear decks are tethered by a spring assembly that produces a spring-tensioned and partially rotational relationship between the decks. The spring assembly allows the decks to extend, compress, and axially rotate relative to each other in a spring-tensioned relationship. The trucks are restricted from fully rotating about the decks through a restriction tab that blocks the trucks from rotating more than 45°. The trucks and wheels include a bracket defined by a slot, and an axle that passes through the slot in the bracket The wheels rotate about the axle. The axle is defined by a planar section that engages the slot, so as to restrict the bracket from tilting forward and backward. This creates greater stability for the trucks and wheels.

One aspect of a bifurcated spring-tethered electric skateboard, comprises:

- a front deck defined by a front upper surface and a front lower surface;
- a front truck rotatably mounted on the front lower surface of the front deck, the front truck comprising a front bracket and a front axel, the front axle defined by a front planar section, the front bracket defined by a front slot, whereby the front planar section engaging the front slot inhibits the front truck from tilting in relation to the front deck;

a restriction tab disposed adjacently to the front truck, the restriction tab blocking the front truck from rotating more than forty-five degrees;

a pair of front wheels rotating about the front axle;

a rear deck defined by a rear upper surface and a rear lower surface;

a rear truck rotatably mounted on the rear lower surface of the rear deck, the rear truck comprising a rear bracket and a rear axle, the rear axle defined by a rear planar section, the rear bracket defined by a rear slot, whereby the rear planar section engaging the rear slot inhibits the rear truck from tilting in relation to the rear deck;

a pair of rear wheels rotating about the rear axle;

a spring assembly joining the decks, whereby the decks extend, compress, and axially rotate relative to each other in a spring-tensioned relationship;

a motor operatively connected to the pair of front wheels and the pair of rear wheels, the motor powering the pair of front wheels and the pair of rear wheels;

an electronic circuit operatively connected to the motor, and a controller operatively connected to the motor, the controller transmitting a signal to the electronic circuit to start or to stop the motor, whereby the pair of front and rear wheels rotate independently of each other.

In another aspect, the front deck comprises a front frame and a front textured panel.

In another aspect, the front textured panel comprises a front grip.

In another aspect, the rear deck comprises a rear frame and a rear textured panel.

In another aspect, the rear textured panel comprises a rear grip.

In at other aspect, the front and rear pair of wheels comprise castor wheels.

In another aspect, the spring assembly comprises a spring member and a tube, the spring member disposed inside the tube.

In another aspect, the restriction tab is oriented perpendicular to the front deck.

In another aspect, the controller is operated remotely.

In another aspect, the motor is an electric motor.

In another aspect, the skateboard further comprises an electric power source.

In another aspect, the electric power source is a battery.

In another aspect, the assembly further comprises a cable for carrying electrical current.

In another aspect, the cable connects the motor to the controller.

In another aspect, the bracket comprises an installation plate.

In another aspect, the bracket comprises a washer.

One objective of the present invention is to provide an electric skateboard that propels a writer in addition to the human power generated by the writer.

Another objective of the invention is to create a wavelike riding sensation for a rider of the skateboard through the use of a spring assembly that joins a bifurcated deck, Yet another objective is to provide a restriction tab that inhibits the front truck from rotating greater than 45°, so as to create a more stable ride.

Yet another objective is to provide a textured grip on the front and rear upper surfaces.

Yet another objective is to provide a controller that regulates the speed of the motor, and thereby the wheels.

Yet another objective is to provide a remote control device that transmits signals to the controller.

Yet another objective is to provide a small, lightweight electric power source that attaches front or rear deck of the skateboard.

Yet another objective is to provide an inexpensive to manufacture electrical, bifurcated skateboard.

Other systems, devices, methods, features, and advantages will be or become, apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
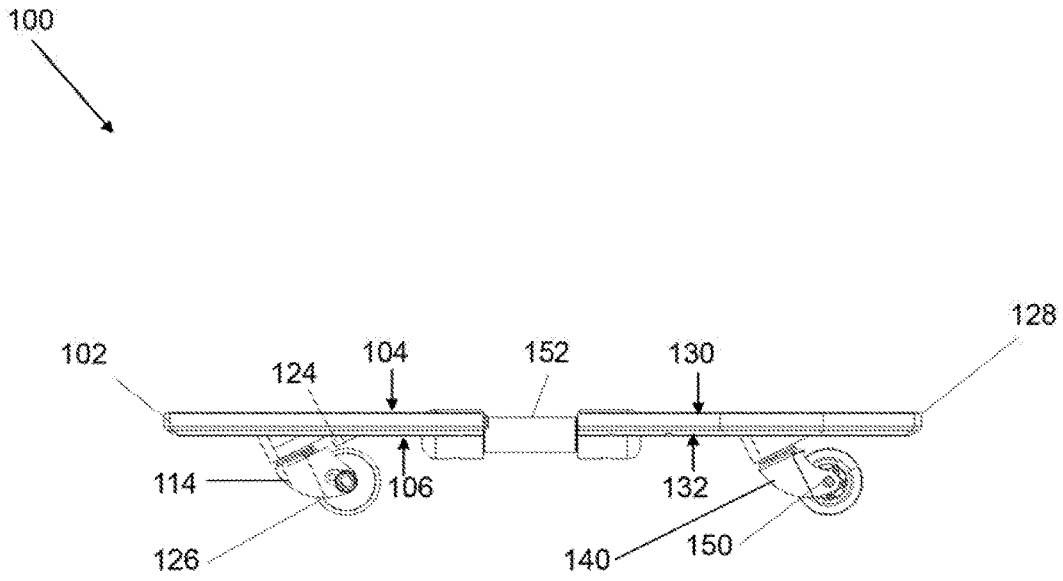
FIG. 1 illustrates a perspective view of an exemplary bifurcated spring-tethered electric skateboard, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. it is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A bifurcated spring-tethered electric skateboard 100 is referenced in FIGS. 1-4. The bifurcated spring-tethered electric skateboard 100, hereafter "skateboard 100" is bifurcated into separate decks 102, 128 that are, joined by a spring-tensioned spring assembly 152, which creates a wavelike riding motion as each deck extends, compresses, and rotates independently of the other. The unique skateboard 100 is also electrically powered and remotely controlled, such that the front and rear pair of wheels 126, 150 rotate independently of each other. Further the skateboard 100 provides front and rear trucks 114, 140 that support the wheels and are restricted from tilting forward and backward through a unique axle and bracket arrangement, The front wheels 126 are prevented from rotating more than 45°, so as to create a more stable ride.

Figure 2:
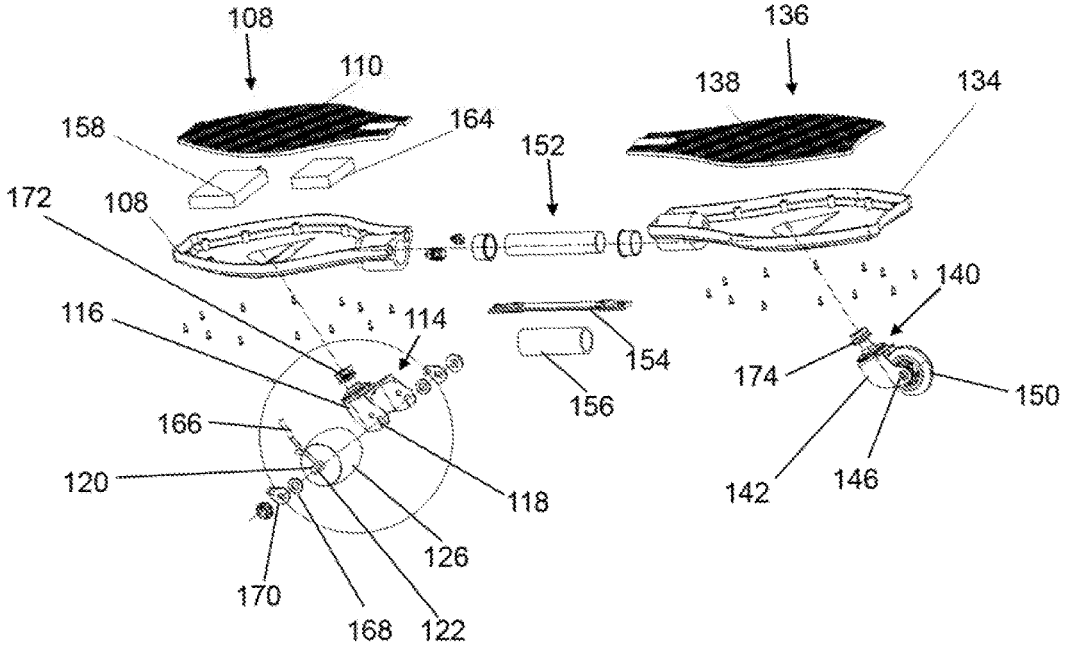
FIG. 2 illustrates a blow up view of a bifurcated spring-tethered electric skateboard, showing a controller and an electric power source operational at the front deck, in accordance with an embodiment of the present invention.

Looking now at FIG. 2, the skateboard 100 is bifurcated into a front deck 102 and rear deck 128 with each deck having independently powered trucks 114, 140 and wheels 126, 150. The skateboard 100 has a mounted electric power source 158, which generates electrical power that is variably and controllably applied to the wheels 126, 150. The skateboard 100 also provides a controller 164 that controls the speed of the motor 160, and thereby the wheels 126, 150. The controller 164 may be electrically connected to the motor 160 for direct control, or may include a wireless transmitter for remote control.

In some embodiments, a spring assembly 152 connects the decks, creating a spring-tensioned effect, between the decks while riding the skateboard 100 The spring effect creates a unique, riding effect for a user. The uneven ride requires that the trucks do not rotate fully. A cable 166 that connects the electrical components can also be damaged from excessive rotation of the trucks. Thus, the skateboard 100 also provides a restriction tab 124 at the bottom surface of the decks that engages the trucks to limit rotations thereof.

Figure 3:
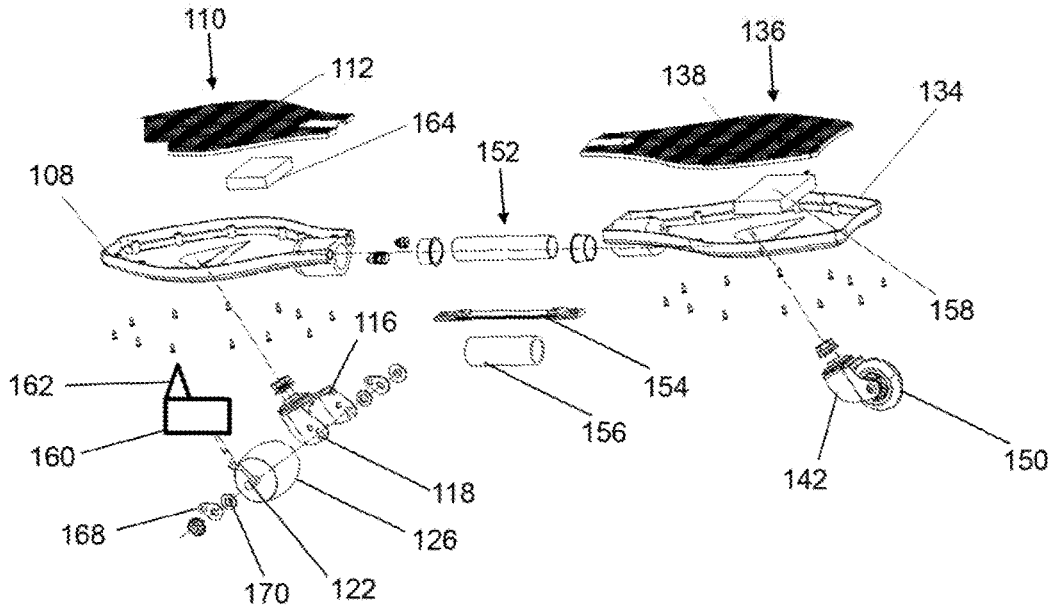
FIG. 3 illustrates a blow up view of a bifurcated spring-tethered electric skateboard, showing a controller at the front deck and an electric power source operational, in accordance with an embodiment of the present invention.

Looking now at FIG. 3, the skateboard 100 is bifurcated into a front deck 102, a front truck 114, and a pair of front wheels 126, The skateboard 100 also includes a corresponding rear deck. 128, rear truck 140, and pair of rear wheels 150. Further, the skateboard 100 includes an electric motor 160, a controller 164, and an electric power source 158 that operatively connect though a cable 166 through the trucks 114, 140, so as to power the wheels 126, 150. Both front and rear wheels 126, 150 are electrically powered to roll, and free to rotate independently of each other. The controller 164 transmits a signal to an electronic circuit 162 carried on the skateboard 100 to start or to stop the motor 160 so that the skateboard 100 may be moved or stopped by electric power in addition to human force.

In some embodiments, the front and rear decks 102, 128 are tethered, by a spring assembly 152 that produces a spring-tensioned and partially rotational relationship between the decks 102, 128. The spring assembly 152 allows the decks 102, 128 to extend, compress, and axially rotate relative to each other in a spring-tensioned relationship. The trucks 114, 140 are restricted from fully rotating about the decks 102, 128 through a restriction tab 124 that blocks the trucks 114, 140 from rotating more than 45°. The trucks 114, 140 and wheels 126, 150 include a bracket 116, 142 defined by a slot 118, 144, and an axle 120, 146 that passes through the slot 122 144 in the bracket 116, 142. The wheels 126, 150 rotate about their respective axles 120, 146. The axle 120, 146 is defined by a planar section 122, 148 that engages the slot 118, 144, so as to restrict the bracket 116, 142 from tilting forward and backward. This creates greater stability for the trucks 114, 140 and wheels 126, 150.

The skateboard 100 further comprises a front deck 102 that is defined by a front upper surface 104 and a front lower surface 106. The front deck 102 is generally flat and elongated, and sufficiently sized for at least one foot of a rider to rest comfortably there on. In some embodiments, the front deck 102 comprises a front frame 108 and a front textured panel 110. The front frame 108 may include an elongated structure, while the front textured panel 110 is sized and dimensioned fit in alignment with the front frame 108. In one embodiment, the front textured panel 110 comprises a front grip 112 that provides a sure footing for a rider. The front grip 112 may include granular members or a sticky substance to enhance the footing of the writer.

A front truck 114 rotatably mounts on the front lower surface 106 of the front deck 102. The front truck 114 comprises a front bracket 116 and a front axle 120. The front axle 120 is defined by a front planar section 122. The front bracket 116 is defined by a front slot 118. The front planar section 122 engages the front slot 118 inhibits the front truck 114 from tilting in relation to the front deck 102.

In some embodiments, the front bracket 116 comprises an installation plate 168 and a washer 170 that are used to fasten the front truck 114 to the front lower surface 106 of the front deck 102. Various other nuts, bolts, magnets, adhesives, and cables may also be used for these fastening functions. In some embodiments, a front connecting shaft 172 joins the front bracket 116 to the front lower surface 106 of the front deck 102.

Those skilled in the art will recognize that the front truck 114 serve four main purposes: 1) to connect the skateboard's wheels to the decks; 2) to provide a wide-ranging steering response, whereby the wheel axles swivel to create a finite turning radius when, by means of lateral weight shifts, the skateboarder tilts the deck about its longitudinal axis; 3) by means of a suspension system, to smoothly and predictably resist the skateboarder's efforts to tilt the front deck, thus stabilizing the skateboard during straight-ahead riding and providing control over the steering response; and 4) by means of the same suspension system, to generate a force which will quickly return the skateboard to the neutral, non-turning position after the rider discontinues a lateral weight shift.

In some embodiments, the skateboard 100 comprises a restriction tab 124 disposed adjacently to the front truck 114. The restriction tab 124 is oriented perpendicular to the front deck 102. The restriction tab 124 blocks the front truck 114 from rotating more than 45°. The restriction tab 124 is primarily to inhibit excessive rotation by the front truck 114 that would damage a cable 166, as discussed below, and create too much directional uncertainty for the skateboard 100. It is significant to note that the restriction tab 124, by preventing full rotation of the front bracket 116, prevents an electronic cable 166 from damage or overextension.

In some embodiments, the skateboard 100 comprises a pair of front wheels 126 rotating about the front axle 120. in one embodiment, the front wheels 126 of the skateboard are suspended in pairs from the underside of the front deck 102 by means of the front truck 114. The pair of front wheels 126 comprise castor wheels. The front wheels 126 move in conjunction with the front bracket 116, such that the heels 126 rotate up to 45°. Though in other embodiments, the wheels are configured to rotate more or less than 45°.

Figure 4:
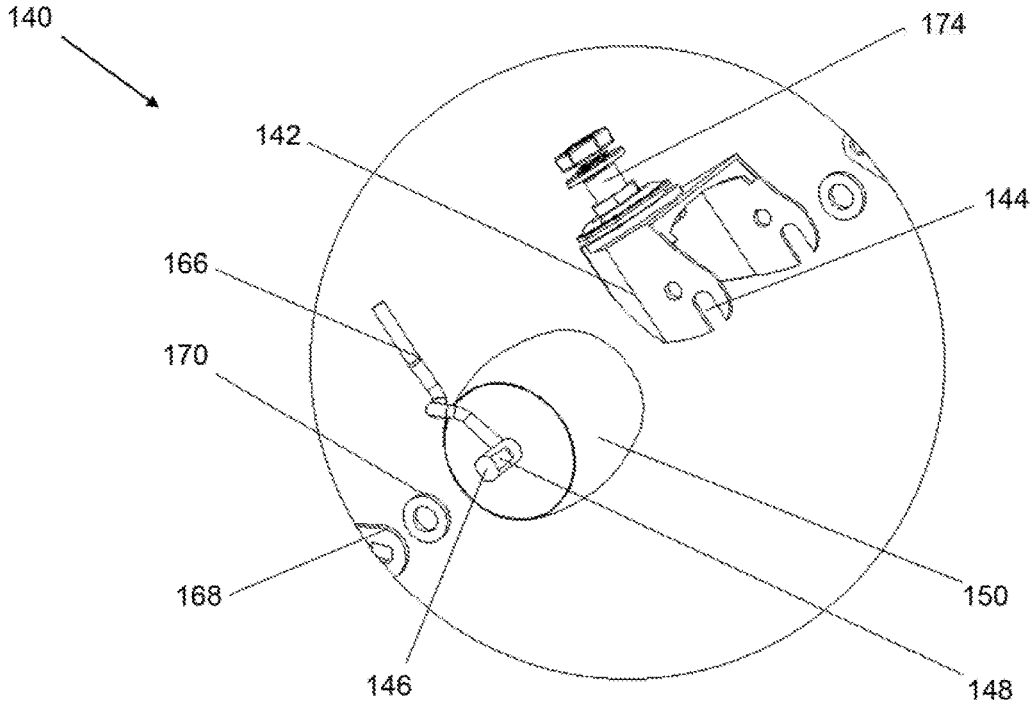
FIG. 4 illustrates a close up view of an exemplary, rear truck, in accordance with an embodiment of the present invention.

As referenced in FIG. 4, the skateboard 100 comprises a rear deck 128 defined by a rear upper surface 130 and a rear lower surface 132. The rear deck 128 comprises a rear frame 134 and a rear textured panel 136. The rear frame 134 may include an elongated structure, while the rear textured panel 136 is sized and dimensioned fit in alignment with the rear frame 134. In one embodiment, the rear textured panel 136 comprises a rear grip 138 that provides a sure footing for a rider. The rear grip 138 may include granular members or a sticky substance to enhance the footing of the writer.

In some embodiments, the skateboard 100 comprises a rear truck 140 rotatably mounts on the rear lower surface 132 of the rear deck 128. The rear truck 140 comprising a rear bracket 142 and a rear axle 146. The rear axle 146 is defined by a rear planar section 148. The rear bracket 142 is defined by a rear slot 144. The rear planar section 148 engages the rear slot 144 to inhibit the rear truck 140 from tilting in relation to the rear deck 128.

In some embodiments, the rear bracket 142 comprises an installation plate 168 and a washer 170 that are used to fasten the rear truck 140 to the rear lower surface 132 of the rear deck 128. Various other nuts, bolts, magnets, adhesives, and cables may also be used for these fastening functions. In some embodiments, a rear connecting shaft 174 joins the rear bracket 142 to the rear lower surface 132 of the rear deck 128.

A pair of rear wheels 150 rotating about the rear axle 146. In one embodiment, the rear wheels 150 of the skateboard 100 are suspended in pairs from the underside of the rear deck 128 by means of the rear truck 140. The pair of rear wheels 150 may include castor wheels. The rear wheels 150 move in conjunction with the front bracket 116, such that the wheels 150 rotate.

In some embodiments, the skateboard 100 comprises a spring assembly 152 the joins the decks 102, 128. The decks 102, 128 are configured to extend, compress, and axially rotate relative to each other in a spring-tensioned relationship. In one embodiment, the spring assembly 152 comprises a spring member 154 and a tube 156. The spring member 154 is disposed inside the tube 156, such that the tube 156 protects the spring member 154 from damage. The spring member 154 may include, without limitation, a coil, a tensioned bar, and a general spring known in the art to create spring tension.

In some embodiments, the skateboard 100 comprises a motor 160 operatively connected to the front wheels 126 and the rear wheels 150. The motor 160 powers the front wheels 126 and the rear wheels 150. In some embodiments, the skateboard 100 comprises an electronic circuit 162 operatively connected to the motor 160. The electronic circuit 162 enables a controller 164, discussed below, to communicate with the motor 160, so, as to regulate the powering of the motor 160.

In some embodiments, the skateboard 100 comprises a controller 164 operatively connected to the motor 160. The controller 164 transmitting a signal to the electronic circuit 162 to start or to stop the motor 160. The front and rear wheels 126, 150 rotate independently of each other. In some embodiments, the controller 164 is operated remotely with a remote control device. Thus, the rider can increase or decrease the speed of the motor 160; and thereby the wheels 126, 150 while writing the skateboard 100, or a second person can control the speed of the skateboard 100 from afar.

A cable 166 is also used to connect the controller 164 to the motor 160. The cable 166 may include a power cable or a data cable that is used to transmit electrical current between the controller 164 and the motor 160. The cable 166 is configured to pass through the brackets 116, 142, and specifically through a cable 166 opening in the bracket 116, 142.

In some embodiments, the skateboard 100 further comprises an electric power source 158. The electric power source 158 may include, without limitation, a battery, a rechargeable battery, a power cord that leads to an external power source, and a solar panel. The electric power source 158 may be operational at the front deck 102, as shown in FIG. 2. However in other embodiments, the electric power source 158 is operational at the rear deck 128, as shown in FIG. 3. In either case, the electric power source 158 is operatively connected to the motor 160 and controller 164 through a cable 166.

These and other advantages of the invention will be further understood and appreciated. by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A bifurcated spring-tethered electric skateboard, the skateboard comprising:

a front deck defined by a front upper surface and a front lower surface;

a front truck rotatably mounted on the front lower surface of the front deck, the front truck comprising a front bracket and a front axle, the front axle defined by a front planar section, the front bracket defined by a front slot, whereby the front planar section engaging the front slot inhibits the front truck from tilting in relation to the front deck;

a restriction tab disposed adjacently to the front truck, the restriction tab blocking the front truck from rotating more than forty-five degrees;

a pair of front wheels rotating about the front axle;

a rear deck defined by a rear upper surface and a rear lower surface;

a rear truck rotatably mounted on the rear lower surface of the rear deck, the rear truck comprising a rear bracket and a rear axle, the rear axle defined by a rear planar section, the rear bracket defined by a rear slot, whereby the rear planar section engaging the rear slot inhibits the rear truck from tilting in relation to the rear deck;

a pair of rear wheels rotating about the rear axle;

a spring assembly joining the decks, whereby the decks extend, compress, and axially rotate relative to each other in a spring-tensioned relationship;

a motor operatively connected to the pair of front wheels and the pan of rear wheels, the motor powering the pair of front wheels and the pair of rear wheels;

an electronic circuit operatively connected to the motor; and a controller operatively connected to the motor, the controller transmitting a signal to the electronic circuit to start or to stop the motor, whereby the pair of front and rear wheels rotate independently of each other.

2. The skateboard of claim 1, wherein the front deck comprises a front frame and a front textured panel.

3. The skateboard of claim 1, wherein the front textured panel comprises a front grip.

4. The skateboard of claim 1, wherein the rear deck comprises a rear frame and a rear textured panel.

5. The skateboard of claim 1, wherein the rear textured panel comprises a rear grip.

6. The skateboard of claim 1, wherein the front and rear pair of wheels comprise castor wheels.

7. The skateboard of claim 1, wherein the spring assembly comprises a spring member and a tube, the spring member disposed inside the tube.

8. The skateboard of claim 1, wherein the restriction tab is oriented perpendicular to the front deck.

9. The skateboard of claim 1, wherein the controller is operated remotely.

10. The skateboard of claim 1, wherein the motor is an electric motor.

11. The skateboard of claim 1, further comprising an electric power source generating electrical power for the motor.

12. The skateboard of claim 11, wherein the electric power source is a battery.

13. The skateboard of claim 1, father comprising a cable for carrying electrical current.

14. The skateboard of claim 13, wherein the cable connects the motor to the controller.

15. The skateboard of claim 1, wherein the front bracket and the rear bracket comprises an installation plate.

16. The skateboard of claim 15, wherein the front bracket and the rear bracket comprises a washer.

17. A bifurcated spring-tethered electric skateboard, the skateboard comprising:

a front deck defined by a front upper surface and a front lower surface;

a front truck rotatably mounted on the front lower surface of the front deck, the front truck comprising a front bracket and a front axle, the front axle defined by a front planar section, the front bracket defined by a front slot, whereby the front planar section engaging the front slot inhibits the front truck from tilting in relation to the front deck;

a restriction tab disposed adjacently to the front truck, the restriction tab blocking the front truck from rotating more than forty-five degrees;

a pair of front wheels rotating about the front axle;

a rear deck defined by a rear upper surface and a rear lower surface;

a rear truck rotatably mounted on the rear lower surface of the rear deck, the rear truck comprising a rear bracket and a rear axle, the rear axle defined by a rear planar section, the rear bracket defined by a rear slot, whereby the rear planar section engaging the rear slot inhibits the rear truck from tilting in relation to the rear deck;

a pair of rear wheels rotating about the rear axle;

a spring assembly joining the decks, whereby the decks extend, compress, and axially rotate relative to each other in a spring-tensioned relationship;

a motor operatively connected to the pair of front wheels and the pair of rear wheels, the motor powering the pair of front wheels and the pair of rear wheels;

an electronic circuit operatively connected to the motor;

a controller operatively connected to the motor, the controller transmitting a signal to the electronic circuit to start or to stop the motor, whereby the pair of front and rear wheels rotate independently of each other, a cable for carrying electrical current, the cable connects the motor to the controller; and an electric power source generating electrical power for the motor.

18. The skateboard of claim 17, wherein the front deck comprises a front frame and a front textured panel.

19. The skateboard of claim 17, wherein the rear deck comprises a rear frame and a rear textured panel.

20. A bifurcated spring-tethered electric skateboard, the skateboard consisting of:

a front deck defined by a front upper surface and a front lower surface, the front deck further comprising a front frame and a front textured panel;

a front truck rotatably mounted on the front lower surface of the front deck, the front truck comprising a front bracket and a front axle, the front axle defined by a front planar section, the front bracket defined by a front slot, whereby the front planar section engaging the front slot inhibits the front truck from tilting in relation to the front deck;

a restriction tab disposed adjacently to the front truck, the restriction tab further disposed perpendicular to the front deck, the restriction tab blocking the front truck from rotating more than forty-five degrees;

a pair of front wheels rotating about the front axle;

a rear deck defined by a rear upper surface and a rear lower surface, the rear deck further comprising a rear frame and a rear textured panel;

a rear truck rotatably mounted on the rear lower surface of the rear deck, the rear truck comprising a rear bracket and a rear axle, the rear axle defined by a rear planar section, the rear bracket defined by a rear slot, whereby the rear planar section engaging the rear slot inhibits the rear truck from tilting in relation to the rear deck;

a pair of rear wheels rotating about the rear axle;

a spring assembly joining the decks, the spring assembly comprising a spring member and a tube, whereby the decks extend, compress, and axially rotate relative to each other in a spring-tensioned relationship;

a motor operatively connected to the pair of front wheels and the pair of rear wheels, the motor powering the pair of front wheels and the pair of rear wheels;

an electronic circuit operatively connected to the motor;

a controller operatively connected to the motor, the controller transmitting a signal to the electronic circuit to start or to stop the motor, whereby the pair of front and rear wheels rotate independently of each other;

a cable for carrying electrical current, the cable connects the motor to the controller; and an electric power source generating electrical power for the motor.

* * * * *